US005087346A

United States Patent [19]

Wietek

[11] Patent Number: 5,087,346

[45] Date of Patent: Feb. 11, 1992

[54] SHEATHING PIPE FOR A STEEL ROD

[76] Inventor: Bernhard Wietek, Farmachweg 290, A-6073, Sistrans, Austria

[21] Appl. No.: 506,839

[22] Filed: Apr. 9, 1990

[30] Foreign Application Priority Data

Apr. 11, 1989 [AT] Austria ..... 844/89

[51] Int. Cl.[5] ..... C23F 13/00; G01N 27/27

[52] U.S. Cl. ..... 204/404; 204/147; 204/153.11

[58] Field of Search ..... 204/147, 148, 196, 197, 204/404, 153.11

[56] References Cited

U.S. PATENT DOCUMENTS

| | | | |
|---|---|---|---|
| 2,053,214 | 9/1936 | Brown | 204/196 |
| 2,076,422 | 4/1937 | Zimmerer et al. | 204/196 |
| 2,076,466 | 4/1937 | Koerber | 204/196 |
| 3,410,313 | 11/1968 | Martin | 204/197 |
| 3,445,370 | 5/1969 | Sherman | 204/197 |
| 4,861,449 | 8/1989 | Onge | 204/197 |
| 4,877,354 | 11/1989 | Williamson | 204/197 |

*Primary Examiner*—T. Tung
*Attorney, Agent, or Firm*—Hale and Dorr

[57] ABSTRACT

A sheathing pipe for an anti-corrosion rod of steel is described, in which the inside of the sheathing pipe has at least one electrode that can make electrical contact with the outside.

2 Claims, 2 Drawing Sheets

SHEATHING PIPE FOR A STEEL ROD

BACKGROUND OF THE INVENTION

The invention concerns a sheathing pipe for a steel rod.

Basically, one way of protecting concrete building structures from corrosion is through the high alkalinity of the concrete, which causes a passive, rust-resistant layer to form on the surface of a steel rod. But the corrosion damage to steel-concrete structures that has been found in recent years primarily involves traffic structures, like bridges, and the primary cause of the damage was the effect of road salt. In addition to salt, the passive layer on the surface of the steel can also be destroyed, for example, when the concrete reacts with carbon dioxide in the surrounding air and thus loses its alkalinity through calcification.

In order to protect the surface of steel suspension supports from the destruction of the protective passive layer described, such steel rods are surrounded with an insulating sheathing pipe, especially one made of plastic. In evaluating the structural status of structures provided with such sheathed suspension steel, however, the problem arises whether the sheathing is 100% effective in preserving the protective surface layer of the rod. The object of the invention is to make it possible to determine this with more certainty.

SUMMARY OF THE INVENTION

For this purpose, according to the invention, the inside of the sheathing pipe is provided with at least one electrode that can make electrical contact with the outside.

The present invention makes it possible to find the potential for corrosion on the surface where the steel touches the concrete. This potential arises because in the stationary position, the number of electrons emitted by the iron is equal to the number of electrons absorbed by the area surrounding the iron (especially to oxygen present there). Therefore, any electrical potential found shows that the dual protection of the steel from the alkalinity of the concrete and from the sheathing pipe is not effective or is not fully effective.

One special advantage of the invention is that it allows the corrosion process, if there is one, to be halted, because by using a high-voltage source, a weak current can be made to flow between the steel rod and the electrodes that deliver as many electrons directly to the steel rod as would be absorbed if corrosion by oxygen were to continue undisturbed. This step, cathode corrosion protection, is known. A special advantage of the cathode corrosion protection lies in the fact that the concrete layer surrounding the steel does not need to be removed if it has lost its alkalinity due to environmental influences, if it is not mechanically destroyed. This has not only economic, but also static advantages, since removing individual corroded parts when necessary causes temporary reduction of the load-bearing capacity, which cannot always be tolerated. Further details on the invention will now be explained in connection with the figures.

DETAILED DESCRIPTION OF THE PREFERRED EMBODIMENTS

Figure 1:
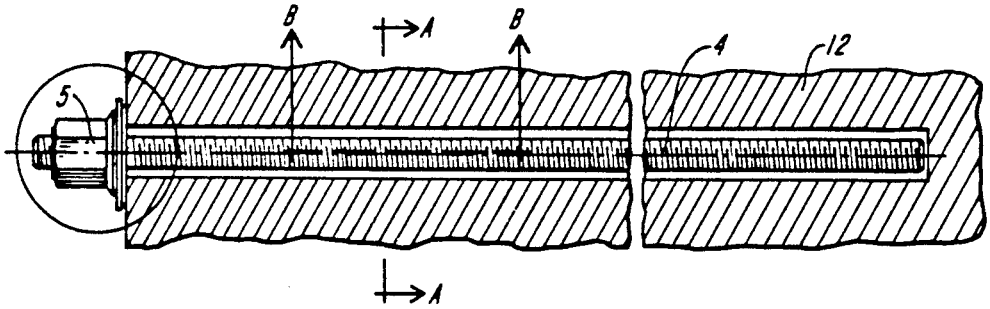
FIG. 1 shows a rod according to the invention after it has been placed in a bore hole.
Figure 2:
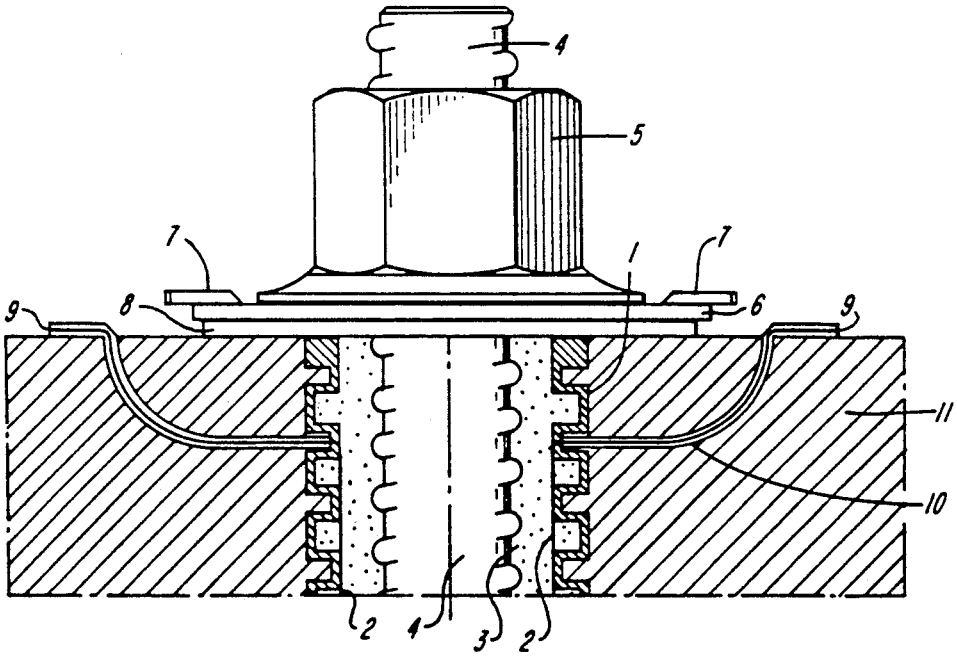
FIG. 2 is a detailed rendering.
Figure 3:
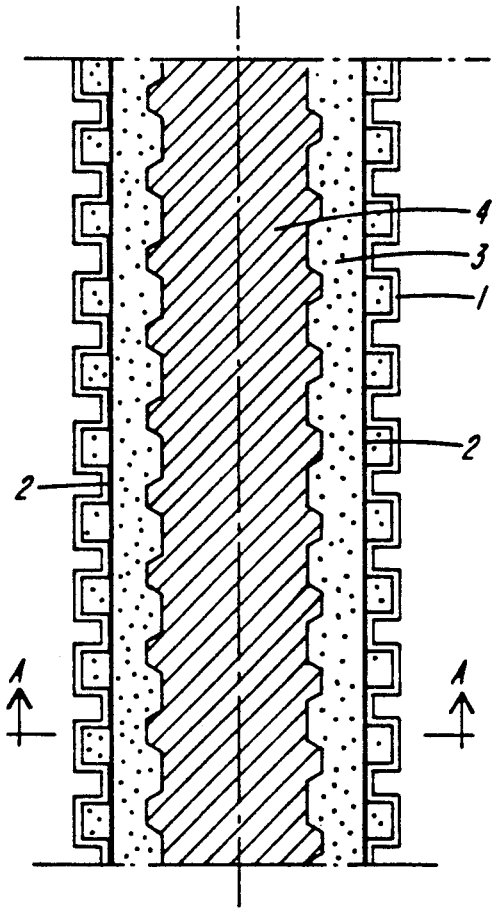
FIG. 3 is a cross section of line B—B in FIG. 1.
Figure 4:
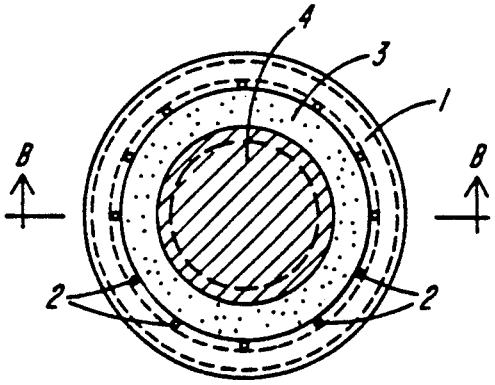
FIG. 4 a cross section of line A—A in FIG. 1.

FIG. 1 shows the arrangement of a reinforcement rod 4 in a bore hole, which is in stone 12. FIGS. 2–4 show a way of sheathing the steel rod 4, itself known, with a sheathing pipe 1 shaped like the one in the invention.

According to the invention, the supports are provided with a sheathing pipe 1, to the inside of which metal wires 2 are attached at the factory. These metal wires can be attached, for example, by heat and solder to the inside of the sheathing pipe, which is made of plastic. The ends of the metal wires 2 pass through insulating hoses 10 to the plugs 9, where electrical contact with a measuring instrument or a voltage source can normally be produced. Between the sheathing pipe 1 and the anti-corrosion rod 4, there is cement mortar 3.

After the support is placed in a bore hole, the space between the stone 12 and the sheathing pipe 1 is wedged in with concrete 11. After the concrete hardens, the steel rod 4 is placed under tension by turning the tension nut 5. Under the tension nut 5, there is, in the embodiment shown in the example, a metal disk 6 with plug-in connections 7 for connecting it to a measuring instrument or a voltage source, and an insulating disk 8 can be placed under the metal disk 6, if necessary.

Instead of feeding each individual metal wire 2 through its own insulating hose 10 to the outside, it would also be possible to connect the metal wires 2 on the inside of the sheathing pipe 1 to one another and to provide only one plug 9, so that there is the option of using only one of the two plugs 7.

As just described, the device shown allows differences in electrical potential between the plugs 7 and 9 to be found that would indicate a corrosive current was flowing. The invention, however, also makes it possible not only to find such a problem, but at the same time, to eliminate it, since voltage can be run between the plugs 7 and 9 to replace the electrons running to the steel rod 4, which it gives off, so that the steel in the steel rod 4 cannot be chemically altered.

What is claimed is:

1. A sheathing pipe system for a steel rod comprising:

a sheathing pipe constructed out of a plastic material and having an interior diameter greater than the external diameter of the steel rod;

a concrete layer surrounding said steel rod and position within said sheathing pipe;

at least one electrode positioned inside the sheathing pipe for detecting corrosive activity within the sheathing pipe and means for connecting said electrode to an electrical device located outside of the sheathing pipe, said electrode being formed by metal wires connected to one another and extending along the sheating pipe.

2. A sheathing pipe system according to claim 1, characterized by the fact that the shape of the wall of the sheathing pipe is meandering in cross section and the metal wires run out from the wall.

* * * * *